US007429415B2

(12) United States Patent
Poulakis

(10) Patent No.: US 7,429,415 B2
(45) Date of Patent: Sep. 30, 2008

(54) ADHESIVE CLOSING PART

(75) Inventor: Konstantinos Poulakis, Hildrizhausen (DE)

(73) Assignee: Gottlieb Binder GmbH & Co. KG, Holzgerlingen (DE)

( * ) Notice: Subject to any disclaimer, the term of this patent is extended or adjusted under 35 U.S.C. 154(b) by 245 days.

(21) Appl. No.: 10/570,520

(22) PCT Filed: Jul. 23, 2004

(86) PCT No.: PCT/EP2004/008214

§ 371 (c)(1),
(2), (4) Date: Mar. 3, 2006

(87) PCT Pub. No.: WO2005/023040

PCT Pub. Date: Mar. 17, 2005

(65) Prior Publication Data

US 2006/0286340 A1 Dec. 21, 2006

(30) Foreign Application Priority Data

Sep. 6, 2003 (DE) ..... 103 41 152

(51) Int. Cl.
*A44B 21/00* (2006.01)

(52) U.S. Cl. ..... 428/99; 428/100; 428/900; 24/442

(58) Field of Classification Search ..... 428/99, 428/100, 900; 24/442
See application file for complete search history.

(56) References Cited

U.S. PATENT DOCUMENTS

| | | | |
|---|---|---|---|
| 5,110,649 | A | 5/1992 | Morse et al. |
| 5,180,618 | A | 1/1993 | Kessler et al. |
| 6,596,371 | B1 | 7/2003 | Billarant et al. |

FOREIGN PATENT DOCUMENTS

| | | | |
|---|---|---|---|
| DE | 199 56 011 | | 6/2001 |
| DE | 100 39 940 | | 3/2002 |
| EP | 0 439 969 | | 8/1991 |
| WO | WO 00/18556 | * | 4/2000 |

* cited by examiner

*Primary Examiner*—Alexander Thomas
(74) *Attorney, Agent, or Firm*—Roylance, Abrams, Berdo & Goodman, L.L.P.

(57) ABSTRACT

An adhesive closing part includes a support band (10) provided with hooking elements (12) disposed thereupon. A cover band (18) covers the support band (10) on the side facing away from the hooking elements (12), and is wider than the support band (10). Lateral edge zones (20) of the cover band (18) extend beyond the associated longitudinal edges of the support band (10) on both sides. At least one additional cover band is provided whose free lateral edge zones also extend beyond the associated longitudinal edges of the support band (10) such that another sealing system is created in addition to a first sealing system, resulting in an overall improvement of the sealing effect.

18 Claims, 1 Drawing Sheet

ADHESIVE CLOSING PART

FIELD OF THE INVENTION

The present invention relates to an adhesive closing part having a support strip with interlocking elements mounted on it and having a cover strip on its side facing away from the interlocking elements covering the support strip. The cover strip is wider than the support strip so that free side edge areas of the cover strip extend on both sides beyond the associated longitudinal edges of the support strip.

BACKGROUND OF THE INVENTION

Adhesive fastener elements are employed for a variety of purposes, such as in automotive technology, flooring technology and clothing of all kinds, and for special applications in mechanical engineering. Adhesive fastener elements provide reliable detachable connections and fastening elements in these fields. When such adhesive fastener elements are used for aircraft or motor vehicle passenger seats, they serve the purpose of fastening seat covers to foamed parts. Some adhesive fastener elements are foamed into the foam upholstery material during production of the respective seat, while the adhesive fastener element with the corresponding interlocking elements is fastened to the cover upholstery material, in particular is sewn on. When producing the foam body element, the adhesive fastener elements are introduced into seating pipes of a foam injection mold. By introduction of foam material into the free cross sections of the foam injection mold, preferably one of PU foam, the adhesive fastener elements are fastened on the foam body elements in the foam injection process. The pipes employed normally project above the other walls of the foam injection mold, and thereby form groove-like recesses in the foam body element which receive the upholstery cover material with the other corresponding adhesive fastener element. In this way geometric seam and shape patterns may be reproduced on a particular seat.

DE-A-199 56 011 discloses an adhesive fastener element for application for this purpose in the seating area, one having a support strip and interlocking elements mounted on the support strip. The support strip has at least one reinforcing element resistant to bending, one which extends preferably along the support strip in the form of a bending wire. Application of that solution results in better embedding properties in foam molds for adhesive fastener elements. Because of the flexural strength of the reinforcing element, once adhesive fastener elements have been introduced into the respective foam injection mold, they remain in their position. The cover strip is applied in one layer so as to be flush with the upper side of the foam injection mold. The possibility is then not to be excluded that, during the foam injection process itself preferably involving polyurethane foam, the foam may raise the cover strip above the side edges of the foam injection mold and so reach the interior of the channel-like injection mold in which the support strip with bending wire and the interlocking elements is seated. However, penetration of the intermediate areas of the interlocking elements by the foam weakens the fastening capability of these elements, so that they may not be effective when engaged with corresponding closing elements of the other component. This penetration on the whole reduces the adherence of the disclosed adhesive fastener elements.

To offset this disadvantage DE-A-100 39 940 discloses, for a generic adhesive fastener element, a cover strip which is wider than the support strip. The two free side edge areas of the cover strip are each folded back on themselves in the direction of the support strip along a fold line extending in the longitudinal direction. The end edges of the free side edge areas of the cover strip face the longitudinal edges of the support strip. As a result, the cover strip has on both sides a sealing lip which always extends along the area having the interlocking elements and which is adjacent to the wall elements of the foam injection mold enclosing the molding depression in which the interlocking elements are received during the foaming process. The foam material introduced into the foam injection mold causes this sealing lip to be pressed against the facing wall elements of the mold. As a result of the certain amount of flexibility in the area of the fold line, the sealing lip rests against the wall areas forming the sealing surface so that the improvement desired in the sealing action as foam barrier is achieved. In order then to impart a certain amount of flexural resistance to the adhesive fastener element, something which perceptibly improves handling during introduction into the foam injection mold, this disclosed solution also has a flexurally resistant element in the form of a bending wire.

Unintentional penetration of foam material in the direction of the interlocking elements may occur even with these disclosed solutions, despite this sealing lip configuration. It has been found in particular that the disclosed solution encounters its limits where the foam injection mold for design reasons has a configuration such that the disclosed solution with its side edge areas does not end flush and level with the upper side of a foam injection mold.

SUMMARY OF THE INVENTION

An object of the present invention is to provide improved adhesive fastener elements so that, while their advantages are retained, they have an even better effect in sealing of the molded foam to be introduced into a foam injection mold and so that they may also be adapted to a large number of geometric patterns of a specified foam injection mold.

This object is basically attained by an adhesive fastener element having at least first and second cover strips. The free side areas of the cover strips extend over the associated longitudinal edges of the support strip. In addition to the first sealing system in the form of the first projecting cover strip, at least one other comparable sealing system is produced by the second cover strip. If the cover system initially facing the foam fails, the other sealing system can produce the effect of sealing off from the molded foam. It has also been found that the geometric surface configuration of the respective cover strip may be configured as desired, so that the solution of the present invention allows a greater range of variation in foam injection molds and their cross sections.

In one preferred embodiment of the adhesive fastener element of the present invention, the widths of the cover strips stacked one above the other may vary. When the adhesive fastener element is in the use position, the respective upper cover strip is one-fourth to one-half, preferably approximately one third, wider than the cover strip immediately below it.

In another especially preferred embodiment of the adhesive fastener element of the present invention, the cover strip, the support strip, the interlocking elements, and/or the adhesive possess ferromagnetic properties at least to some extent. The adhesive fastener element may then be held in place on the foam injection mold by a magnetic retaining unit such as one in the form of permanent magnet strips in the foam injection mold or in the seating pipe of the foam injection mold. Such strips are embedded in the strip-like adhesive fastener element when the element is aligned.

In order to impart a certain amount of bending resistance to the intrinsically flexible adhesive fastener element with its components, a stiffening section may be embedded in the adhesive layer positioned between cover strip and support strip. The stiffening section definitely facilitates handling of the adhesive fastener element when it is introduced into the foam injection mold or the foam injection pipe, especially if specified lengths of the adhesive fastener element are to be introduced into the respective foam injection mold in complex three-dimensional structures. This section may be represented by an iron wire provided with a corrosion-proofing coating, one of zinc in particular. Use of a ferromagnetic stiffening wire may also contribute to magnetic securing of the adhesive fastener element in position on the foam injection mold.

The interlocking elements of the adhesive fastener element of the present invention may be in the form of stalk-shaped, hooked, looped, fleece-like, or mushroom-shaped fastener elements.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure.

DETAILED DESCRIPTION OF THE INVENTION

Figure 1:
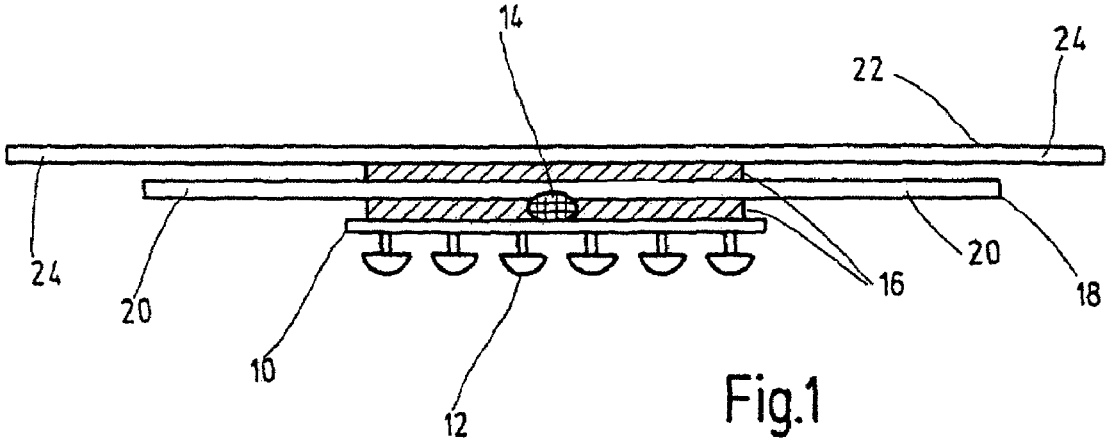
FIG. 1 is a diagrammatic, not to scale, front elevational view of an adhesive fastener element according to an embodiment of the present invention.

An adhesive fastener element according to an embodiment of the present invention has a support strip 10. Interlocking elements 12 mounted side by side and one behind another are present on one side of the support strip 10. For example, the adhesive fastener element may be a microfastener in which 200 to 400 interlocking elements per square centimeter are provided on a support strip 10 of a thickness of 0.1 mm to 0.3 mm. An exemplary process for production of the support strip 10 of such microfastener is disclosed in DE-C-198 28 856. In this disclosed process, a thermoplastic material is introduced by an extrusion tool into the gap between a pressure tool and a molding tool. A sieve having through openings is used as shaping element. The interlocking elements are in the form of plastic setting at least to some extent in the holes in the sieve. In addition to that sieve molding process, a different extrusion or casting process may be applied for production of the support strip 10 with interlocking elements 12.

The support strip 10 has a bending-resistant profile-like stiffening element extending over or along the entire length of the support strip 10. In the exemplary embodiment illustrated, this stiffening section comprises a wire 14, in particular a metal wire. This wire 14 is rigidly connected by an adhesive layer 16 on the rear side of the support strip 10 facing away from the interlocking elements 12. The layered adhesive layer 16 may comprise, for example, a moisture cross-linking polyurethane (PU), an acrylate adhesive or other suitable adhesive means. The adhesive layer 16 essentially covers one side of the support strip 10 and is rigidly connected to it. The diameter relationships selected are such that the thickness of the adhesive layer applied corresponds approximately to the cross section of the wire 14. However, as indicated in the figures, it is also possible for the adhesive layer 16, in view of its thickness, to receive the wire 14 with its cross section as specified only in part and embed it.

The adhesive layer 16 is adjoined by a first cover strip 18, which is wider than the support strip 10, so that free side edge areas 20 of the cover strip 18 extend on both sides over the longitudinal edges of the support strip 10. As illustrated in the stacked configuration, another adhesive layer 16 is applied after the first cover strip 18. This second adhesive layer 16 immobilizes another or second cover strip 22 along its lower side. The two free side edge areas 24 of this second cover strip 22 also extend beyond the associated longitudinal edges of the support strip 10. The widths of the respective cover strips 18, 22 may be specified as desired. The configuration of these strips is based on the cross-sectional shapes of the respective foam injection pipe as the molded foam element. The possibility accordingly exists of designing a cover strip 18 or 22 to be wider or of the same width in an asymmetric configuration as the respective adjacent opposite cover strip 22 or 18. In addition, the configuration of the present invention need not be restricted to a two-component configuration of cover strips. The stack number may be increased as a function of the application. In the configuration of the adhesive fastener element shown in its use position, however, the uppermost or second cover strip 22 is approximately one-third wider than the immediately following subjacent or first cover strip 18.

The cover strips 18, 22 may be formed of a textile material, a non-woven material, or a preferably open-pored plastic fabric, to achieve good adhesion of the foam at least to the upper cover strip 22. Reliable bonding of the adhesive fastener element to the molded foam (not shown) is thereby achieved.

Figure 2:
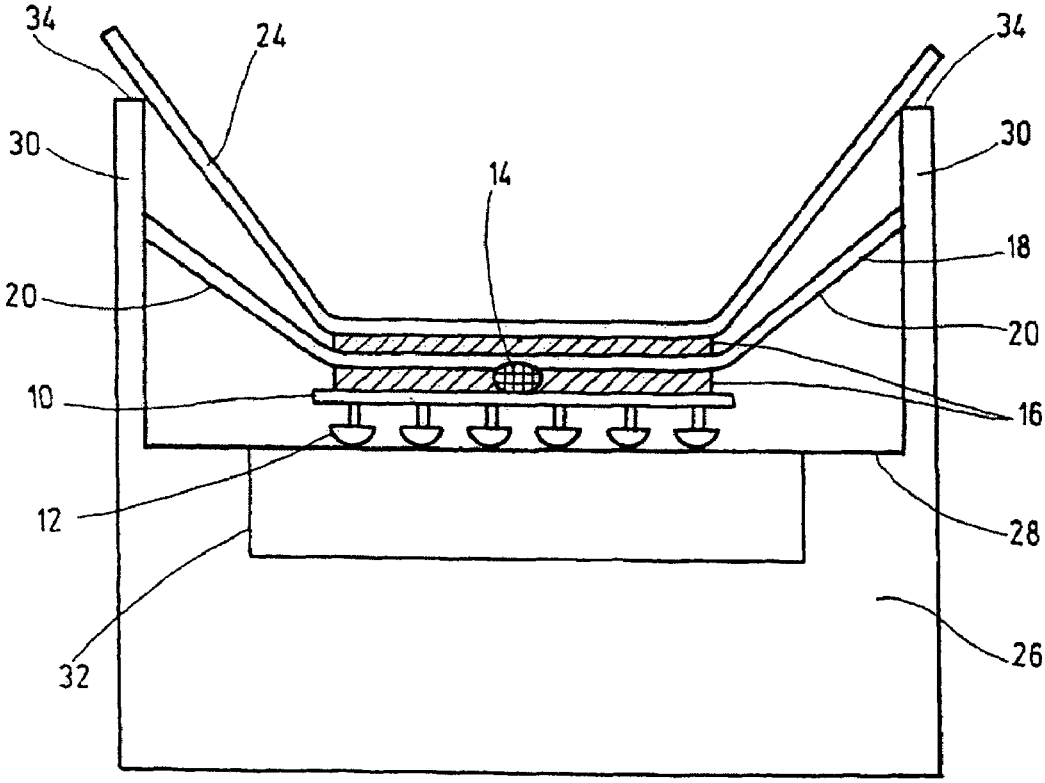
FIG. 2 is a front elevational view of a part of a foam injection mold (foam injection pipe) with adhesive fastener element of FIG. 1 positioned on it in the use position.

The illustration in FIG. 2 relates to use of an adhesive fastener element as shown in FIG. 1. Part of a foam injection mold as the molding tool, in technical language also referred to as foam injection pipe 26, is shown in cross section in FIG. 2. The foam injection pipe 26 forms in cross section a channel-like foam injection mold having a bottom element 28 with two side walls 30 projecting vertically in the same direction and to the same height. In addition, there is introduced into the bottom element 28 of the foam injection pipe a bar-shaped magnet element 32. The magnet element functions as part of a ferromagnetic adherence system in conjunction with the corresponding components of the adhesive fastener element shown in FIG. 1. Provision may also be made such that the respective cover strip 18, 22 and/or the support strip 10 and/or the interlocking elements 12 and/or the adhesive layer 16 at least to some extent possess ferromagnetic properties. The iron particles preferably employed may be integrated into the respective element of the adhesive fastener element and/or applied to the respective components as a coating. The possibility also exists of applying a ferromagnetic powder as a coating paste. Depending on the components of the adhesive fastener element provided with ferromagnetic properties, preferably a full-area contact with the magnet element 32 of the foam injection mold 26 is obtained.

As FIG. 2 also shows the adhesive fastener element of the present invention is introduced into the channel-like foam injection tool 26 with both side edge areas 20 of the first cover strip 18 in interior contact with the side walls 30 of the foam injection tool 26. The two side edge areas 24 of the second cover strip 22 extend to some extent over, on and beyond the free ends 34 of these side walls 30. If foam material is now introduced into the foam injection mold, it is retained by the first sealing area formed between the two side edge areas 24 and free ends 34 of the side walls 30. Any foam material which nevertheless succeeds in penetrating this first sealing area is then forced back by the second sealing system formed by the side edge areas 20 of the first cover strip 18 and the interior of the two side walls 30 of the foam injection tool 26. The sealing effect of the second sealing system is increased further in that the foam flowing in presses the first cover strip 18 with its two side edge areas 20 against the side walls 30.

It has been found to be especially favorable for the effectiveness of sealing to cause the respective side edge areas 20, 24 to project wing-like above the support strip 10, in particular to provide angular bending areas. The side edge areas 20 extend at angles within the a range of 20° to 45°, preferably 30°, from the horizontal or a horizontal base or planar portion thereof. The other side edge areas 24 extend at an angle of 30° to 60°, preferably approximately 45°, from the horizontal or a horizontal base or planar portion thereof.

The adhesive fastener element of the present invention is especially well suited for aircraft or motor vehicle passenger seats. It serves for fastening seat covers on foam body elements. Some adhesive fastener elements are injected into the upholstery foam material along with the foam in production of the respective seat. The adhesive fastener elements are fastened by the corresponding interlocking elements to the upholstery cover material.

While one embodiment has been chosen to illustrate the invention, it will be understood by those skilled in the art that various changes and modifications can be made therein without departing from the scope of the invention as defined in the appended claims.

What is claimed is:

1. A method of applying an adhesive fastener element, comprising the steps of:

forming an adhesive fastener element with a support strip having first and second opposite sides and having longitudinal edges, interlocking elements mounted on the support strip and extending from the first side, and first and second cover strips mounted on and covering the second side, the first cover strip being wider than the support strip and having first free longitudinal edge areas extending on both sides thereof beyond the longitudinal edges of the support strip and at angles in a range of 20 to 45 degrees relative to a horizontal base thereof, the second cover strip being mounted on a side of the first cover strip remote from the support strip, being wider than the support strip and having second free longitudinal edge areas extending beyond the longitudinal side edges of said support strip and at angles in a range of 30 to 60 degrees relative to a horizontal base thereof; and introducing the adhesive fastener element into a channel-shaped foam injection tool with the first free edge areas contacting inside surfaces of side walls of the tool and with the second free edge areas extending at least to some extent over and on free ends of the side walls.

2. A method according to claim 1 wherein the first and second cover strips have different widths.

3. A method according to claim 2 wherein the second cover strip is between about one-forth and one-half wider than the first cover strip.

4. A method according to claim 2 wherein the second cover strip is about one-third wider than the first cover strip.

5. A method according to claim 1 wherein the first cover strip is joined to the support strip by a first adhesive layer; and the second cover strip is joined to the first cover strip by a second adhesive layer.

6. A method according to claim 1 wherein the cover strips are formed of one of textile material, non-woven material and plastic fabric; and the interlocking elements are formed of one of polyamide and polypropylene.

7. A method according to claim 1 wherein the support strip and the interlocking elements are formed by extrusion and molding.

8. A method according to claim 1 wherein at least one of the first and second cover strips, the support strip, the interlocking elements and adhesive layers joining the first cover strip to the support strip and joining the second cover strip to the first cover strip possesses magnetic properties interacting with a magnet in the foam injection tool.

9. A method according to claim 1 wherein the adhesive fastener element is stiffened by a bending wire extending along the support strip and magnetically interacting with a magnet in the foam injection tool.

10. A method according to claim 1 wherein the first edge areas extend at angles of about 30 degrees relative to the horizontal base thereof; and the second edge areas extend at angles of about 45 degrees relative to the horizontal base thereof.

11. A foam molding installation, comprising:

an adhesive fastener element including a support strip having first and second opposite sides and longitudinal edges, interlocking elements on said support strip and extending from said first side, a first cover strip mounted on and covering said second side, being wider than said support strip and having first free longitudinal edge areas extending on both sides thereof beyond said longitudinal edges of said support strip and at angles in a range of about 20 to 45 degrees relative to a horizontal base thereof, and a second cover strip mounted on and covering a side of said first cover strip remote from said support strip, being wider than said support strip and having second free longitudinal edge areas extending beyond the longitudinal side edges of said support strip and at angles in a range of about 30 to 60 degrees relative to a horizontal base thereof; and a channel-shaped foam injection tool having side walls with inside surfaces and with free ends, said injection tool receiving said adhesive fastener element with said first edge areas contacting said inside surfaces and said second edge areas extending at least to some extent over and on said free ends of said side walls.

12. A foam molding installation according to claim 11 wherein said second cover strip is between about one-fourth and about one-half wider than said first cover strip.

13. A foam molding installation according to claim 11 wherein said second cover strip is about one-third wider than said first cover strip.

14. A foam molding installation according to claim 11 wherein said first cover strip is joined to said support strip by a first adhesive layer; and said second cover strip is joined to said first cover strip by a second adhesive layer.

15. A foam molding installation according to claim 11 wherein said cover strips comprise one of textile material, non-woven material and plastic fabric; and said interlocking elements comprise one of polyamide and polypropylene.

16. A foam molding installation according to claim 11 wherein at least one of said first and second cover strips, said support strip, said interlocking elements and adhesive layers joining said first cover strip to said support strip and said second cover strip to said first cover strip possesses magnetic properties; and said injection tool comprises a magnet interacting with said magnetic properties.

17. A foam molding installation according to claim 11 wherein a bending wire extends along and stiffens said support strip; and said injection tool comprises a magnet magnetically interacting with said bending wire.

18. A foam molding installation according to claim 11 wherein said first edge areas extend at angles of about 30 degrees relative to said horizontal base thereof; and said second edge areas extend at angles of about 45 degrees relative said horizontal base thereof.

* * * * *